US006460506B1

(12) United States Patent
Nevinger

(10) Patent No.: US 6,460,506 B1
(45) Date of Patent: Oct. 8, 2002

(54) SPARK PLUG HAVING AN ENCAPSULATED ELECTRODE GAP

(75) Inventor: Ronald D. Nevinger, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/661,708

(22) Filed: Sep. 14, 2000

(51) Int. Cl.[7] ..... F02P 15/00
(52) U.S. Cl. ..... 123/260; 313/143; 29/888.1
(58) Field of Search ..... 123/260, 263, 123/266, 262, 143 B, 267, 143 R, 256; 313/143; 29/888.01

(56) References Cited

U.S. PATENT DOCUMENTS 4,242,990 A * 1/1981 Scherenberg et al. .. 123/169 PA
4,516,548 A * 5/1985 May ..... 123/169 EL
4,987,868 A 1/1991 Richardson
5,105,780 A 4/1992 Richardson
5,947,076 A 9/1999 Srinivasan et al.
6,016,785 A 1/2000 Divecha et al.

FOREIGN PATENT DOCUMENTS

DE 27 01 235 A1 * 10/1977 ..... F02B/19/10
NL WO 85/02066 * 9/1985 ..... H01T/13/54

* cited by examiner

*Primary Examiner*—John Kwon
*Assistant Examiner*—Hieu T. Vo
(74) *Attorney, Agent, or Firm*—Keith P Roberson

(57) ABSTRACT

Encapsulated spark plugs improve combustion control in spark ignited engines. The present invention improves reliability and life of an encapsulated spark plug. A spark plug shell has a connection region and an orificed region, and a tip portion. The present invention provides improved heat transfer from the tip portion through the orificed region to the connection region. An access orifice provides access to set an electrode gap.

13 Claims, 2 Drawing Sheets

SPARK PLUG HAVING AN ENCAPSULATED ELECTRODE GAP

TECHNICAL FIELD

This invention relates generally to a spark ignition device and more particularly to an encapsulated spark plug.

BACKGROUND ART

Emissions and efficiency continue driving technology to improve combustion of air and fuel mixtures. Many improvements have come by controlling the air and fuel mixture. These controls have come through improved design of combustion chambers, improved valving, improved control of fuel, and atomization of fuel. These improvements all generally improve control of the fuel and air mixture.

Unlike in a diesel cycle engines, spark ignited engines may also control a combustion event through initiation of a spark. Encapsulated spark plugs combine improvements gained by improving condition and mixing of fuel and air along with improvements gained by controlling initiation of the spark. An encapsulated spark plug includes a plug shell surrounding an electrode gap. The plug shell defines an ignition chamber separate from a combustion chamber. The ignition chamber also separates a flame kernel from turbulence in the combustion chamber. As a piston compresses an air/fuel mixture in the combustion chamber, at least a portion of the air/fuel mixture passes through orifices on the plug shell into the ignition chamber.

In the ignition chamber, a spark causes the portion of air/fuel mixture to combust resulting in a pressure rise in the ignition chamber. As the pressure in the ignition chamber overcomes pressures in the combustion chamber, hot gasses escape from ignition chamber forming multiple ignition into the air/fuel mixture in the combustion chamber. Multiple ignition torches increase combustion rates in the combustion chamber and reduce masses of unburned air/fuel mixture. Richardson shows encapsulated spark plugs in both U.S. Pat. No. 4,937,868 issued Jan. 29, 1991 and U.S. Pat. No. 5,105,780 issued Apr. 21, 1992.

Increased temperature environments experienced by encapsulated spark plugs tend to reduce their lives. Operation in a lean air/fuel mixture increases required break down voltages needed to jump an electrode gap between an electrode and ground electrode. Increased break down voltages requires a greater electrical insulation between the electrode and ground electrode. The increased electrical insulation often means increasing a heat transfer path between a capsule connected to the ground electrode and a cool environment. Further exacerbating wear, the orifices through the plug shell experience extreme temperature changes. Hot gas exits the ignition chamber through the orifices at high velocities. These high velocities increase heat transfer from the hot gases to the plug shell. However, resistance such as welds hinder heat transfer away from the orifices The present invention is directed to overcoming one or more of the problems as set forth above.

DISCLOSURE OF THE INVENTION

In one aspect the present invention includes a spark plug having an encapsulated electrode gap. The spark plug has an insulator. A spark plug shell has an insulator retention region, a connection region, an orificed region, and a tip portion. The insulator retention region connects with the insulator. The connection region is adapted to engage a cylinder head. The spark plug shell has a plurality of orifices. A first electrode connects with the insulator, and the insulator separates the first electrode from the spark plug shell. A second electrode connects with the spark plug shell. A plug shell cap connects with the spark plug shell adjacent the tip portion.

In another aspect of the present invention, a method of making an encapsulated spark plug includes forming a spark plug shell with a plurality orifices. A second electrode is connected to the spark plug shell. The second electrode is insulated from a first electrode. An electrode gap between the first electrode and the second electrode is adjusted through an access orifice of the spark plug shell. The access origin is then covered.

BEST MODE FOR CARRYING OUT THE INVENTION

Figure 1:
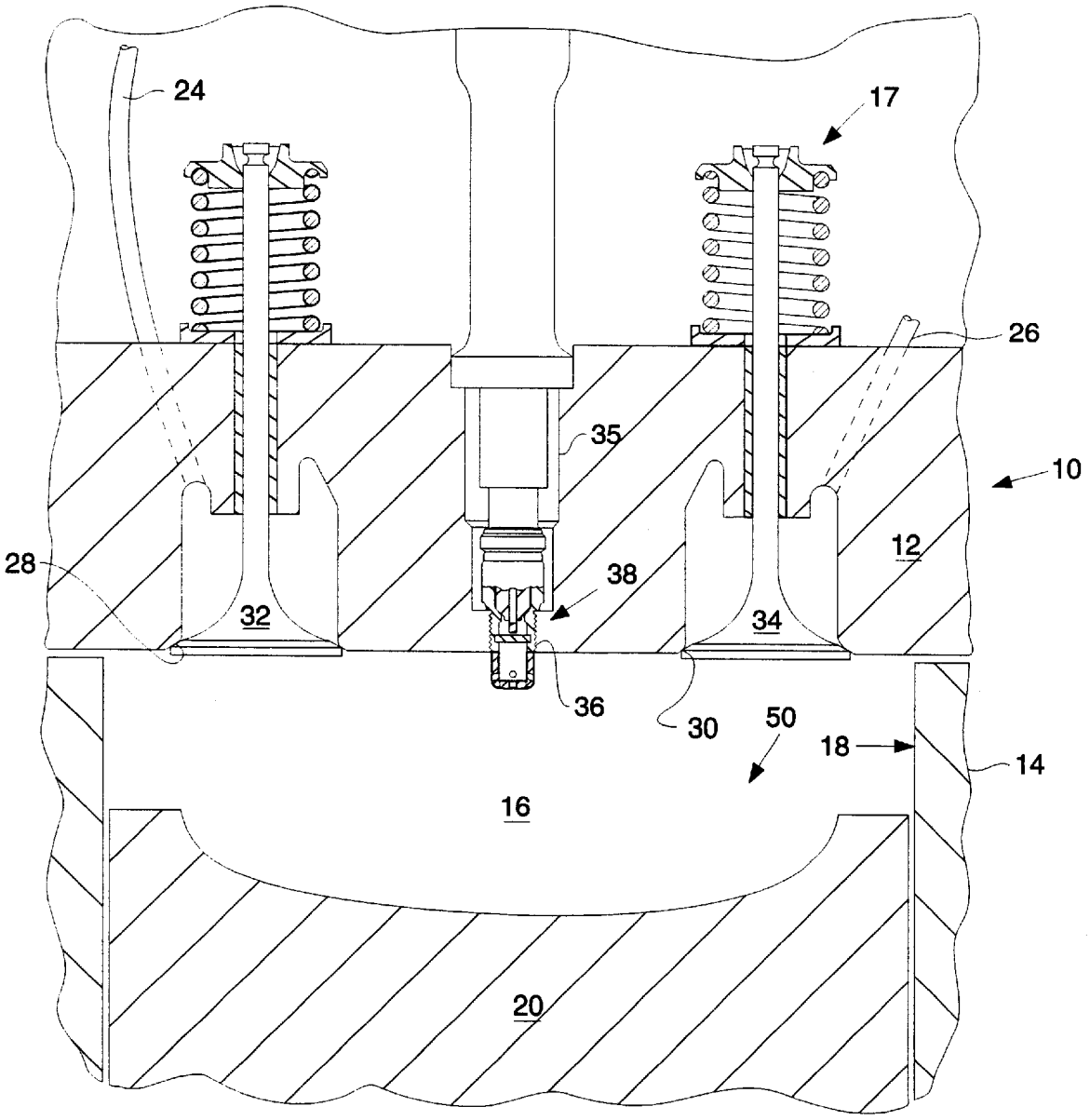
FIG. 1 is a cross section view of a spark ignited internal combustion engine.

In FIG. 1 a spark ignited combustion engine 10 has a cylinder head 12 sealingly connected with a cylinder block 14. A combustion chamber 16 is defined by a cylinder wall 18 in the cylinder block 14, the cylinder head 12, and a piston 20. The piston 20 slidingly engages the cylinder wall 18 in a conventional manner.

The cylinder head 12 has at least one port (not shown) fluidly connecting the combustion chamber 16 with a fuel conduit (not shown), an inlet conduit 24, and an exhaust conduit 26. For this application, the engine 10 has a first inlet port 28, a second inlet port (not shown), a first exhaust port 30, and a second exhaust port (not shown). The inlet ports 28 fluidly connect to the inlet conduit 24. The exhaust ports 30 fluidly connect to the exhaust conduit 26. While the fuel conduit may connect directly with the combustion chamber 16, this application has the fuel conduit connecting with inlet conduit 24 upstream of the inlet port 28. An inlet valve 32 is movably positioned in the inlet port 28 and an exhaust valve 34 is movably positioned in the exhaust port 30. The engine may have multiple inlet valves 32 and exhaust valves 34 for each combustion chamber 16. Each engine 10 may have multiple combustion chambers 16 arranged in numerous manners such as inline, V, flat, or radial configurations.

The cylinder head 12 further includes a spark plug well 35 having a connection portion 36. In this application, the connection portion 36 is threaded. The spark plug well may also include cooling channels (not shown). However, the connection portion 36 may be any conventional connection mechanism able to withstand pressures, temperatures, and chemistry compatibility typical of a combustion process. A spark plug 38 sealingly connects with the cylinder head 12.

Figure 2:
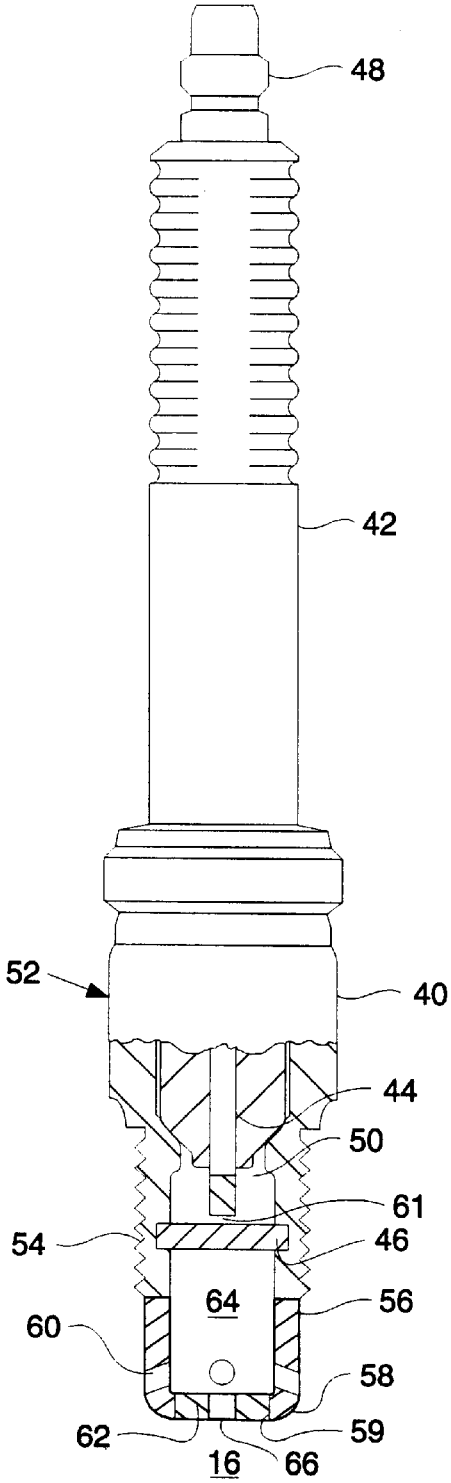
FIG. 2 is a view of an encapsulated spark plug having an embodiment of the present invention.

FIG. 2 show the spark plug 38 having a spark plug shell 40, insulator 42, first electrode 44, and a second electrode 46. The first electrode 44 has a first portion 48 connected to a power source (not shown) and a second portion 50. The first electrode 44 is made of a material having good electrical conductivity and heat resistance such as a nickel alloy. The insulator should electrically isolate the first electrode from the second electrode while still maintaining structural integrity in a high temperature environment such as a ceramic. The insulator 42 connects and covers the first electrode 44 between the first portion 48 and second portion 50.

The spark plug shell 40 has an insulator retention region 52, a connection region 54, an orificed region 56, and a tip portion 58. The insulator retention region 52 sealingly connects with the insulator 42 proximate the second portion 50 of the first electrode 44. In this application, the connection region 54 connects with the connection portion 36 of the spark plug well 34. As mentioned above, any conventional manner of connection may be used. The orificed region 56 defines a plurality of orifices 60 intermediate of the connection region 54 and the tip portion 58. The tip portion 58 is in closest proximity to the combustion chamber 16 including being within the combustion chamber 16. The tip portion 58 defines an access orifice 59 sufficiently large to access the first electrode 44 and the second electrode 46. The second electrode 46 connects with the spark plug shell 40 preferably near the connection region and extends radially inward towards the first electrode 44. A predetermined distance between the first electrode 44 and the second electrode 46 creates an electrode gap 61. The plug shell 40 is made from a material having high thermal conductivity, high thermal stability, and resistance to environmental corrosion in high temperatures up to 2100 F. (1150 C.). In this embodiment, a nickel alloy containing about 99% by weight nickel is used. Other ferrous and non-ferrous alloys may also be used. Similarly, corrosions resistant surface treatments may provide corrosion resistance.

A plug shell cap 62 sealingly connects with the tip portion 58 of the spark plug shell 40. The plug shell cap 62, the spark plug shell 40, and the insulator 42 define an ignition chamber 64. In this application, the plug shell cap 62 is connected to the tip portion 58 by a full depth conventional TIG welding process. Other conventional connection methods such as brazing may also be used so long as they withstand the high temperature and high pressure environment. The plug shell cap 62 may be made from a second material having high thermal conductivity, high thermal stability, and resistance to environmental corrosion in high temperatures up to 2100 F. (1150 C.). In this application, the first material and second material are the same. However, the first material and second material may be different.

Industrial Applicability

The spark plug 38 in this application improves control of the combustion process and improves life over current design spark plugs. Much of the improved life results from improved heat transfer from the orificed region 56 through the spark plug shell 40 to cylinder head 12. Improved heat transfer prevents pre-ignition or premature detonation that may otherwise result from overheating of the spark plug shell 40.

In operation, the piston 20 as it moves through its compression stroke pushes a fuel/air mixture from the combustion chamber through the orificed region 56 into the ignition chamber 64. At a predetermined time, the power source creates a voltage differential between first electrode 44 and second electrode 46. The insulator 42 prevents the first electrode from transferring the voltage between the first electrode 44 and second electrode 46. As the voltage differential increases, a spark travels between the first electrode 44 and second electrode 46. The spark ignites the fuel/air mixture.

As the fuel/air mixture combusts, pressure and temperature of the fuel/air mixture increases. The fuel/air mixture in the ignition chamber 64 eventually increases to a pressure sufficient to promote flow of combustion gas through the orificed region 56 at high velocities back into the combustion chamber 16. High velocities and high temperatures of the combustion gas promote rapid heating of the orificed region 56. However, the spark plug shell 40 provides an uninterrupted heat transfer path to the cylinder head 12 to promote rapid cooling of the orificed region 56. Without proper cooling the spark plug shell 40 and plug shell cap begin to store energy and experience increased temperatures. With increased temperatures, the spark plug shell 40 and shell cap 62 may become sources of premature ignition.

The access orifice 59 provides ready access to set the spark gap between the first electrode 44 and second electrode 46. Further, the plug shell cap 62 connects with the spark plug shell 40 to provide heat transfer away from plug shell cap 62 into the cylinder head 12 and maintains the plug shell cap 62 at temperatures sufficiently low to prevent pre-ignition or premature detonation.

Other aspects, objects, and advantages of this invention can be obtained from a study of the drawings, the disclosures, and the appended claims.

What is claimed is:

1. A spark ignited internal combustion engine comprising:

a cylinder head;

a cylinder block being connected to said cylinder head;

a combustion chamber being defined by said cylinder head and said cylinder block;

a piston being movable within said combustion chamber;

an encapsulated spark plug connected to said cylinder head, said spark plug having a spark plug shell, a first electrode, an insulator, a second electrode, and a plug shell cap, said first electrode being separated from said second electrode by an insulator, said second electrode being connected to said spark plug shell, said spark plug shell having a tip portion adjacent said combustion chamber, said spark plug shell having a plurality of orifices, said spark plug shell having an access orifice proximate said tip portion, said plug shell cap being connected to said tip portion.

2. The spark ignited internal combustion engine as specified in claim 1 further comprising a shell cap orifice in said plug shell cap.

3. A spark plug having an encapsulated electrode gap comprising:

a first electrode;

an insulator covering at least a portion of said first electrode;

a spark plug shell being connected to said insulator, said insulator insulating said first electrode from said spark plug shell, said spark plug shell having a plurality of orifices therethrough;

a second electrode being connected to said spark plug shell interior to an ignition chamber;

a plug shell cap being connected to a tip portion of said spark plug shell.

4. The spark plug as specified in claim 3 wherein said plug shell cap is made from a nickel alloy.

5. The spark plug as specified in claim 4 wherein said spark plug shell is made from the nickel alloy.

6. The spark plug as specified in claim 3 wherein said spark plug shell is made from a ferrous alloy having a corrosion resistant surface treatment.

7. The spark plug as specified in claim 3 wherein said plug shell cap has a shell cap orifice.

8. The spark plug as specified in claim 3 wherein said plug shell cap is welded to said tip portion.

9. A method of making an encapsulated spark plug comprising the steps:

forming a spark plug shell having a plurality of orifices;

connecting a second electrode to said spark plug shell;

insulating said second electrode from a first electrode;

adjusting an electrode gap between said first electrode and said second electrode through an access orifice adjacent a tip portion of said spark plug shell;

substantially covering said access orifice.

10. The method as specified in claim 9 wherein said insulating step is covering said first electrode with an insulator.

11. The method as specified in claim 9 wherein said substantially covering step is connecting a plug shell cap to said tip portion of said spark plug shell.

12. The method as specified in claim 11 further comprising the step of forming a shell cap orifice in said plug shell cap.

13. The method as specified in claim 11 wherein said connecting step is welding said plug shell cap to said tip portion.

* * * * *